US006332599B1

(12) United States Patent
Spartz

(10) Patent No.: US 6,332,599 B1
(45) Date of Patent: Dec. 25, 2001

(54) FOOTING FORMS FOR CONCRETE MONOLITH CONSTRUCTION

(76) Inventor: James R. Spartz, 618 Circle Pines Dr., Brainerd, MN (US) 56401

( * ) Notice: Subject to any disclaimer, the term of this patent is extended or adjusted under 35 U.S.C. 154(b) by 0 days.

(21) Appl. No.: 09/386,066

(22) Filed: Aug. 30, 1999

(51) Int. Cl.[7] ..... E04G 11/06

(52) U.S. Cl. ..... 249/34; 249/33; 249/45; 52/274; 52/293.3; 52/309.12

(58) Field of Search ..... 249/34, 18, 35, 249/36, 38, 33, 40, 42, 43, 44, 45, 216, 219.1; 52/274, 293.1, 293.3, 294, 309.11, 309.12

(56) References Cited

U.S. PATENT DOCUMENTS

| | | | | |
|---|---|---|---|---|
| 940,463 | | 11/1909 | Kay . | |
| 953,383 | | 3/1910 | Holman . | |
| 1,332,617 | | 3/1920 | Dodge . | |
| 1,511,087 | | 10/1924 | McKenna . | |
| 1,563,581 | | 12/1925 | May . | |
| 1,607,072 | | 11/1926 | Gremel . | |
| 2,250,064 | | 6/1941 | Jorsch . | |
| 2,251,775 | | 8/1941 | Arrighini . | |
| 2,313,880 | | 3/1943 | Leggett . | |
| 2,511,829 | | 6/1950 | Arrighini et al. . | |
| 2,614,311 | | 10/1952 | Shook . | |
| 2,661,517 | | 12/1953 | Findley . | |
| 2,899,735 | | 8/1959 | Graef . | |
| 3,171,185 | | 3/1965 | Anderson . | |
| 3,722,849 | | 3/1973 | Luyben . | |
| 3,778,020 | | 12/1973 | Burrows et al. . | |
| 3,797,800 | | 3/1974 | Loy . | |
| 4,426,061 | * | 1/1984 | Taggart | 249/45 |
| 4,938,449 | * | 7/1990 | Boeshart | 249/40 X |
| 4,967,528 | * | 11/1990 | Doran | 52/309.12 |
| 5,076,535 | | 12/1991 | Vetter . | |
| 5,367,845 | * | 11/1994 | Hartling | 52/293.1 |
| 5,399,050 | | 3/1995 | Jacobus . | |
| 5,511,761 | | 4/1996 | Schultz . | |
| 5,535,981 | | 7/1996 | Goris . | |
| 5,570,552 | * | 11/1996 | Nehring | 249/91 X |
| 5,575,870 | | 11/1996 | Suenaga et al. . | |
| 5,591,286 | | 1/1997 | Suenaga et al. . | |
| 5,611,182 | | 3/1997 | Spude . | |
| 5,635,097 | | 6/1997 | Aiello . | |
| 5,794,393 | | 8/1998 | Fearn . | |
| 5,798,011 | | 8/1998 | Suenaga et al. . | |
| 5,799,399 | | 9/1998 | Schultz . | |
| 5,809,726 | | 9/1998 | Spude . | |
| 5,861,105 | * | 1/1999 | Martineau | 249/40 X |
| 5,882,540 | | 3/1999 | Farrington . | |
| 5,922,236 | | 7/1999 | Zuhl . | |

FOREIGN PATENT DOCUMENTS

| | | | | |
|---|---|---|---|---|
| 2643933-A1 | * | 9/1990 | (FR) | 249/40 |
| 2090900-A | * | 7/1982 | (GB) | 249/40 |

* cited by examiner

*Primary Examiner*—David Bagnell
*Assistant Examiner*—Jong-Suk Lee
(74) *Attorney, Agent, or Firm*—Albert W. Watkins

(57) ABSTRACT

Footing forms border the bottom of an open space into which concrete may be poured. The forms are adjustable to various widths and lengths, and further provide support for commercially available foam wall forms that are used in concrete wall construction. The combination of adjustable footing forms with foam wall forms allows wall and footing to be poured together to form a monolithic concrete structure. The footing forms are adjustable to work in association with various standard and non-standard widths of foamed resin wall forms used in the building construction industry. The footing forms are fully removable from the concrete monolith, while leaving the foam wall forms with the cast concrete. Various corner components are also illustrated.

10 Claims, 8 Drawing Sheets

FOOTING FORMS FOR CONCRETE MONOLITH CONSTRUCTION

BACKGROUND OF THE INVENTION

1. Field of the Invention

This invention pertains to static molds generally, and more particularly to molds used in the simultaneous formation of footings and walls of a monolithic cast static structure such as a commercial building or a home. The structure will most preferably be molded from concrete, though other materials could also find application.

2. Description of the Related Art

The building trade has been a part of history through all time. A seemingly infinite number of structures have been designed, frequently capitalizing on materials plentiful to a particular area or region. Dwellings have been constructed structurally from such plant based materials as straw, bamboo and wood, and have evolved to include "two by" natural lumber and engineered material construction. Various adobe, rock and earthen materials are also used, and brick and concrete are fabricated for the building trade from raw materials taken from the earth with minimal processing. Ice and snow have been used in the construction of igloos, and, in fact, even various natural formations such as caves have been converted to dwellings.

Buildings provide shelter for inhabitants and their possessions against the elements of nature. As recorded cumulative knowledge has expanded through time and experiences, mankind has learned to identify desirable features of a dwelling, including such things as resistance to storm and flood waters, extreme winds and temperatures, and even insects, rodents and other uninvited creatures of nature. In many regions and localities around the world, the wisdom and experience gained through time has been codified into various building regulations to help ensure safety and protection of a region's citizens and inhabitants. Whether legislatively mandated or not, it is most preferred that dwellings offer resistance to the environment, even in the case of an infrequent event such as severe weather, fire, flooding or other natural disaster. In addition, it is desirable that the building structure offer durability through as much time as possible, by resisting aging brought on by time and the elements. Low cost and simple construction are also desired, but may not always be associated with a particular material or structure.

One material which is associated with many desirable features is concrete, particularly when the concrete is further reinforced with steel. Steel reinforced concrete structures tend to be incredibly resistant to the elements, surviving incredible winds, floods, fires, ground contact, insects and extreme temperatures. As a result, concrete will last for many years and will survive most of the disasters that all too often destroy other buildings. In a reasonably designed and suited location, the life expectancy of concrete is measured in centuries rather than years. In fact, concrete in many applications may only be outlasted by relatively massive stone construction, which is far more expensive, much less available and far harder to convert into a building than concrete. Furthermore, and in part due to its massiveness, concrete offers other advantages such as thermal and physical mass which aid in wind and storm resistance and also provide a moderation of external temperatures.

In the residential construction industry, concrete is the material of choice for most footings and foundations, and many basement walls. In these below grade projects, standard timbers will not withstand ground contact.

Furthermore, the surrounding soil will most often also be quite massive, and the structure needed to withstand ground forces and hydraulic pressures will desirably be quite rugged.

Nevertheless, concrete has been slow to gain widespread use in the above-ground home construction industry, even though frequently used for foundations and basements. In no significant part this has been due to the cost of constructing an above-ground structure from concrete. Heretofore, in order to cast the concrete into the shape of a building or dwelling, the concrete had to be retained in some type of a static mold. These molds have, in the past, been manufactured from wood at the job site, or, in some cases, from steel or aluminum for more long term use by concrete workers. In the case of wood molds, a form is required on the inside surface of the concrete and also on the outside surface. As a result, concrete required a full, double-wall timber construction prior to pouring the concrete. The effort required to construct such a double wall is less than but similar to that required to entirely fabricate a wood two-by structure. Once the static forms are assembled or built, then the concrete must be poured, and, finally, the molds torn down and removed. Furthermore, and unlike with a foundation, seams need to be sealed or protected in some way to prevent the finished concrete from also showing the seam. So, in the prior art timber-based molds, concrete effectively required as much or even more labor and lumber as that required to assemble a lumber house, and then further required the expenses associated with the concrete and pouring. In short, concrete has been a significantly more expensive building material than lumber.

Metal forms manufactured from aluminum and steel have also been devised for casting concrete walls at a job site. Unfortunately, these molds tend to be very expensive, and frequently, due to their size and weight, require special cranes or cable-type lifts to raise and lower the forms. Once a form is placed, various fasteners must be anchored to the surrounding mold forms. When the concrete casting is complete, fasteners must be removed and molds again raised and lowered by cranes and removed from the job site to storage. Once again, the labor associated with this construction, not to mention the additional machinery, exceeds that which would be required for the standard timber construction, therefore driving the cost of the building up once again and reducing the demand for such alternative materials. Furthermore, these massive forms undesirably require substantial storage space when not in use.

Appearance is also an issue with concrete. The casting of concrete can be fairly difficult, and the possibility of a less-than-perfect finished exterior is great. As aforementioned, seams must not be allowed to show, which requires eliminating or hiding the seams in the molds. Furthermore, in the event of an error or flaw, patching or repairing concrete is quite difficult and undesirable. Finally, concrete is not conducive to the placement of utilities such as electrical wiring or plumbing using standard techniques.

Thermal characteristics of concrete, which can be a benefit, also may be a detriment. Exposed concrete surfaces, while acting as a thermal mass, can also be a site for undesirable condensation on a hot and humid day. Concrete does not itself act as a very good thermal insulator, and so may be quite cold on a cold day and get undesirably warm on a hot day.

As a result of the expenses associated with molding and shaping, the difficulties of working with utilities and alterations subsequent to casting, and the issues associated with thermal conductivity and condensation, concrete has traditionally found limited application. Concrete has been reserved for buildings which justify the additional cost as a result of the unique benefits obtained with the material. For example, many schools have been built from concrete, anticipating that the school building will be used for many years to come and desiring that the building provide a safe and durable structure that may also serve the additional purposes of storm shelter, community building, etc. Commercial properties are often manufactured from concrete, for reasons mimicking those for schools. Nevertheless, the methods available for molding the concrete were simply not cost effective for most residential or single-story construction projects.

More recently, a new type of foamed resin form has been devised for molding concrete. This type of form is illustrated, for example, in U.S. Pat. No. 5,896,714 to Cymbala et al; U.S. Pat. No. 5,852,907 to Tobin et al; U.S. Pat. No. 5,845,449 to Vaughan et al; U.S. Pat. No. 5,809,728 to Tremelling; U.S. Pat. No. 5,809,727 to Mensen; U.S. Pat. Nos. 5,809726 and 5,611,182 to Spude; and U.S. Pat. No. 5,803,669 to Bullard; each which is incorporated herein by reference for their relevant teachings. These forms include various features which facilitate assembly of a complete building structure. They may be interlocking, so that the forms are readily stacked, and may also include structure within the form to support various additional components such as re-bar which will serve to reinforce the concrete. Advantageously, these foamed resin forms are designed to remain with the building structure, and so do not require removal after the concrete has been cast. Consequently, the foamed resin form will act as substantial thermal insulation, and a building so constructed will normally not require any further insulation. The resulting walls are thermally insulated against heat and cold, and yet still maintain the benefits of concrete in terms of structural integrity and thermal mass. The resulting structures may be built for much lower cost than when using the traditional timber form and concrete method, and yet provide for an outstanding composite finished product with features and benefits exceeding those of concrete alone.

Nevertheless, and while there are many companies now manufacturing these foam concrete forms in various dimensions and styles, there still remains an issue which has not been adequately resolved. In these prior art construction techniques, footings are most typically framed and poured, and then allowed to cure. Then the foamed resin forms are assembled about these footings or on top of the footings, and then the walls are poured next. Finally, roofing components are installed to complete the exterior structure. Floors may be poured simultaneous with the footings, walls or at any other time as deemed appropriate by the builder. As is apparent, the assembly of footing forms, pouring of concrete and then removal of the footing forms has much of the drawback associated with the older construction techniques found with the walls. Moreover, concrete must be delivered to a job site on two separate occasions, which is also undesirable. Furthermore, the walls and footings are then formed with a seam therebetween, which is also undesirable.

In order to improve the efficiency of construction of a concrete wall and footing, a number of artisans in the construction industry have proposed various forms for simultaneously pouring footings and walls. The following U.S. patents are incorporated herein by reference for their respective teachings of various monolithic forms and construction methods: Kay in U.S. Pat. No. 940,463; May in U.S. Pat. No. 1,563,581; Gremel in U.S. Pat. No. 1,607,072; Jorsch in U.S. Pat. No. 2,250,064; Arrighini in U.S. Pat. No. 2,251,775 and U.S. Pat. No. 2,511,829; Findley in U.S. Pat. No. 2,661,517; Shook in U.S. Pat. No. 2,614,311; Luyben in U.S. Pat. No. 3,722,849; Vetter in U.S. Pat. No. 5,076,535; Schultz in U.S. Pat. No. 5,511,761 and U.S. Pat. No. 5,799,399; Farrington in U.S. Pat. No. 5,882,540; and Zuhl in U.S. Pat. No. 5,922,236. Nevertheless, none of these monolithic forms teach or suggest a way to take advantage of the various foamed resin forms available, and so suffer from the drawbacks noted hereinabove with regard to concrete structures manufactured without foamed resin forms.

SUMMARY OF THE INVENTION

In a first manifestation, the invention features steel forms on each side of an open space into which concrete may be poured. The forms are adjustable to work in association with various form widths used in the building construction industry, and are fully removable from the concrete monolith, while leaving the foam wall forms with the cast concrete. Special support ledges align and support the foam forms, and a special compression lip associated therewith ensures removal of the forms subsequent to the solidifying or curing of the concrete. By using the forms in conjunction with foamed wall forms, the wall and footing may be poured together to form a monolithic concrete structure.

In a second manifestation, the invention is a removable form for shaping a subterranean footing portion of a monolithic concrete footing and wall. The wall is characterized by a foam form which remains permanently with the monolith. The removable form includes first and second longitudinally extensive walls for retaining concrete, a spacer for adjusting spacing between the removable form's walls, and supporting ledges having a vertical support face vertically supporting the foam form and a horizontal support face supporting the foam form. The removable form is removable subsequent to curing the concrete without disrupting either the concrete or the foam form.

In a third manifestation, the invention is a static mold for casting a footing corner upon a substrate from a cementitious material, at the juncture of two building walls and a footing. A longitudinally extending footing mold has a closure adjacent the corner for preventing escape of cement from the footing mold. A first hinge guide is coupled to the footing mold and has a pin pathway. A second, similar footing mold also has a closure for preventing escape of cement, and also has a hinge guide with a pin pathway. A pin passes through each hinge guide, so that the two footing molds may pivot with respect to each other.

OBJECTS OF THE INVENTION

A first object of the invention is to provide a concrete footing form which works cooperatively with commercially available foam wall forms to allow a single concrete pour to form a monolithic building or residence. A second object is to make the concrete footing form removable from the foam and concrete for re-use. A third object is to make the concrete footing form adjustable to accommodate a wide variety of manufacturer's foam forms, so that the footing forms may be used without deference to or limitation of a single foam form vendor. A further object of the invention is to design footing forms which may be manufactured using well-developed and relatively low-cost manufacturing techniques. Another object of the present invention is to enable the footing forms to be readily assembled at a job site and then be readily disassembled for transport and compact storage. Yet another object of the invention is to enable the footing forms to be readily assembled throughout quite complex wall arrangements, and include angles formed to any degree while still functionally fulfilling the other objects of the invention. A further object is to ensure that the footing forms are readily removable from a monolith after the concrete cures. These and other objects are achieved by the present invention, which will be better understood when considered with respect to the exemplary preferred embodiment and associated drawing figures.

DESCRIPTION OF THE PREFERRED EMBODIMENT

Figure 1:
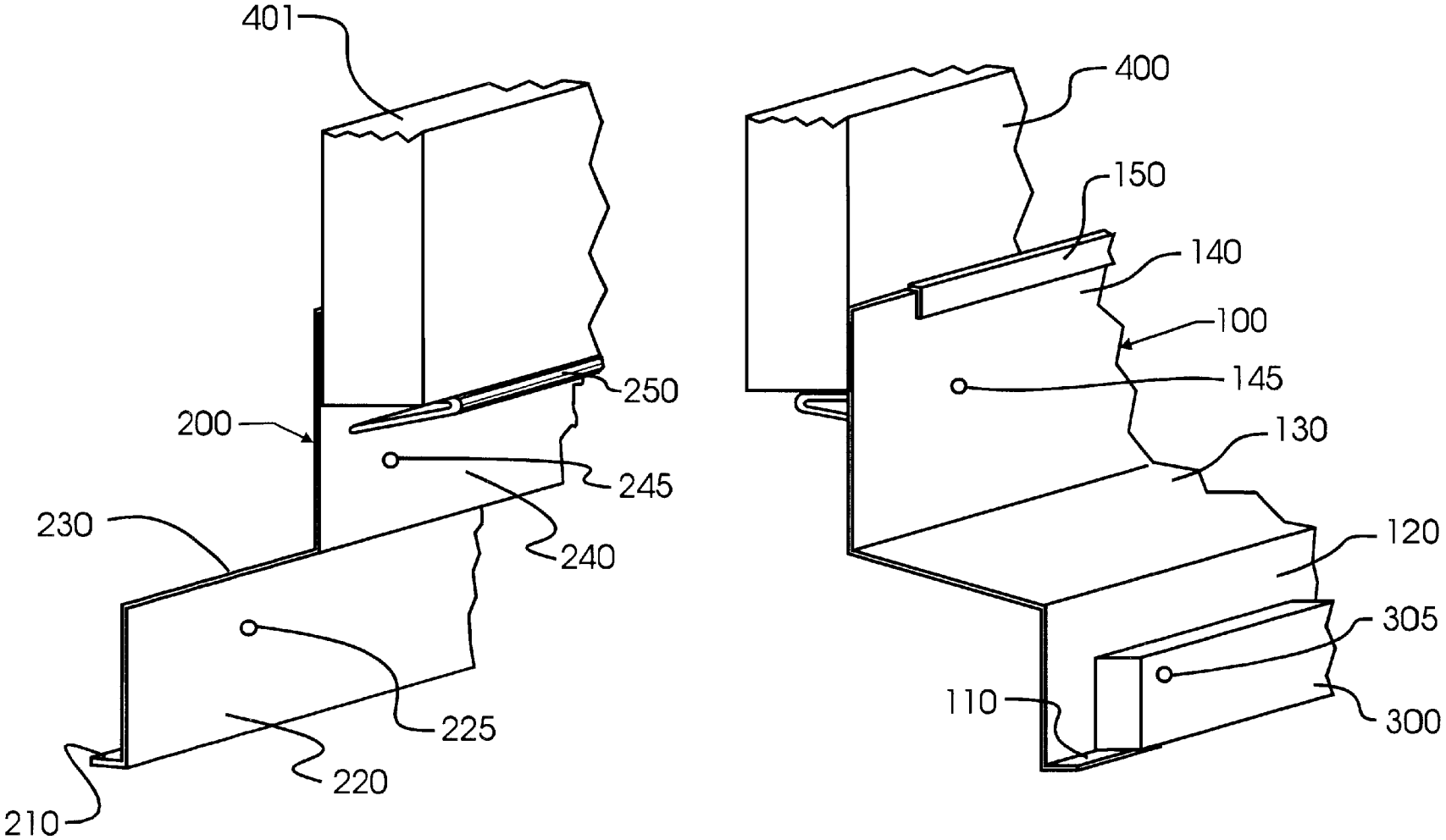
FIG. 1 illustrates preferred embodiment linear and opposed footing forms from an end projected view and further including foam wall forms placed thereon, and without tie-rods for illustrative purposes.

Inside linear footing form 100 and outside linear footing form 200, which comprise the preferred embodiment linear footing forms designed in accord with the present invention, are, in the preferred embodiment, identical in construction. Nevertheless, for particular reference herein they have been separately numbered by different designations in the hundreds digit. Where like components are referenced, the tens and ones digits of the elements are identical. These components perform like function and, in most cases, are of identical construction, except where specifically noted or illustrated herein.

Each of the footing forms 100 and 200 include a base lip, 110 and 210 respectively, upon which a standard timber or lumber 2×4 300 may be located. Lumber 300 provides a stiffening and anchoring effect to forms 100, 200, and simultaneously provides simple attachment, through nails or screws for example, to stakes or other such devices that might be used to accurately align and fix forms 100, 200 at the right level and position them relative to a ground surface upon which they rest. A simple linear bend such as might, for example, be formed in a standard metal brake, separates base lips 110, 210 from base vertical extension 120, 220, respectively. Base vertical extensions 120, 220 form the vertical walls of the wide part of footings found in the prior art concrete monolithic constructions. A simple linear bend which, once again may be formed in a metal brake, forms the junction between base vertical extensions 120, 220 and sloping side walls 130, 230 respectively. While sloping side walls 130, 230 are most preferred since the amount of concrete used is reduced without adversely affecting performance of the resultant footings, it will be apparent to those of ordinary skill that angles other than those illustrated herein may be utilized without compromising the inventive nature or performance of the preferred embodiment or straying from the scope of the present invention.

Sloping side walls 130, 230 terminate approximately at the exterior faces of foamed resin forms 400, 401 where a linear bend leads to vertically-oriented top extensions 140, 240. Suspended from top extensions 140, 240 are foam support ledges 150, 250, respectively. Foam support ledges 150, 250 serve to support vertically extending foam wall forms 400, 401 respectively. Between is foam wall form 400 and foam wall form 401, and also between footing forms 100 and 200, there is a space which will in the preferred embodiment be filled with concrete. It is not essential that concrete be used as the core material, and in fact the invention is applicable to a very wide variety of construction materials that may have suitable characteristics. Nevertheless, in the preferred embodiment, concrete is most preferred based upon cost, availability, ease of filling forms, and general industry familiarity with the characteristics and behavior of concrete during casting.

Figure 2:
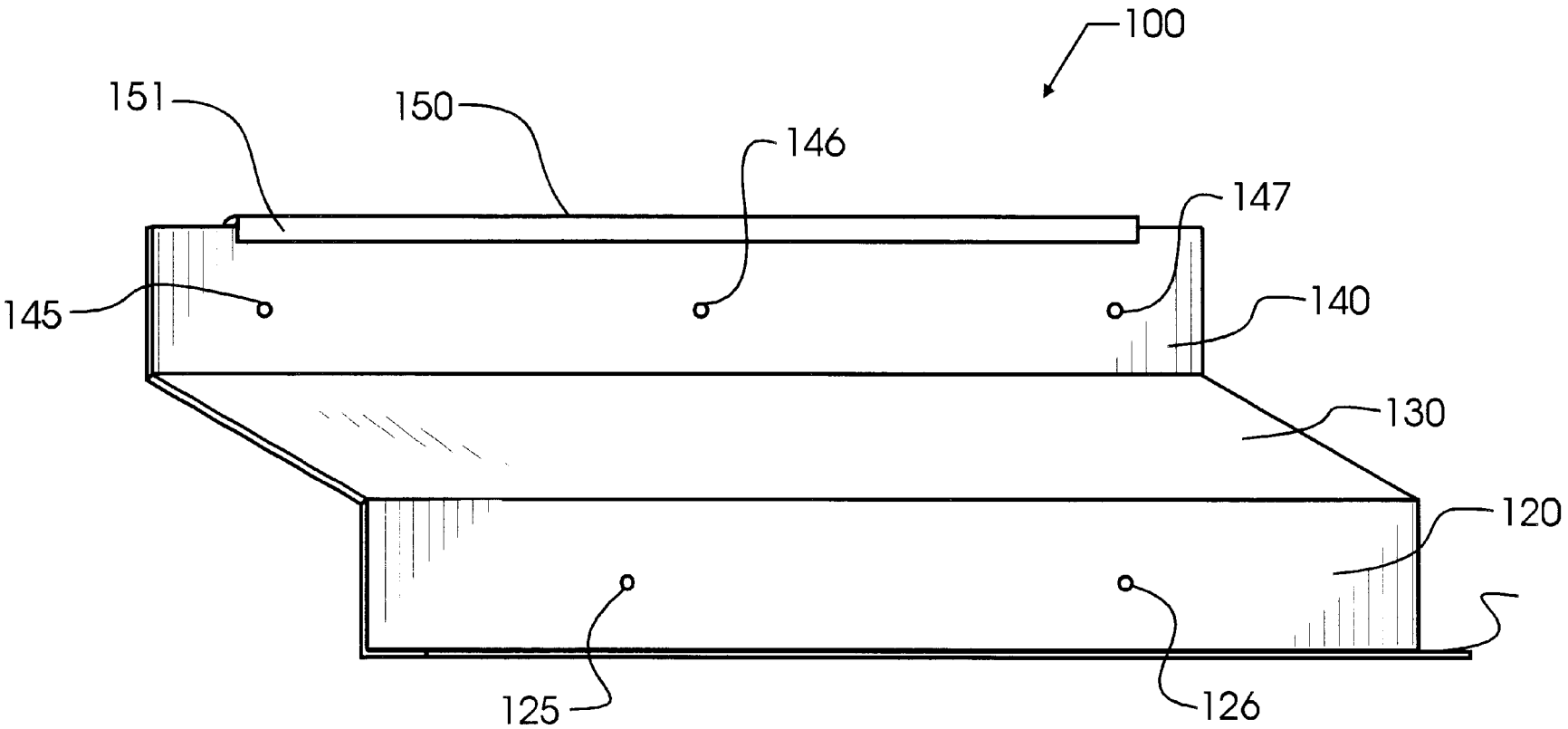
FIG. 2 illustrates an outside projected view of one linear footing form.
Figure 3:
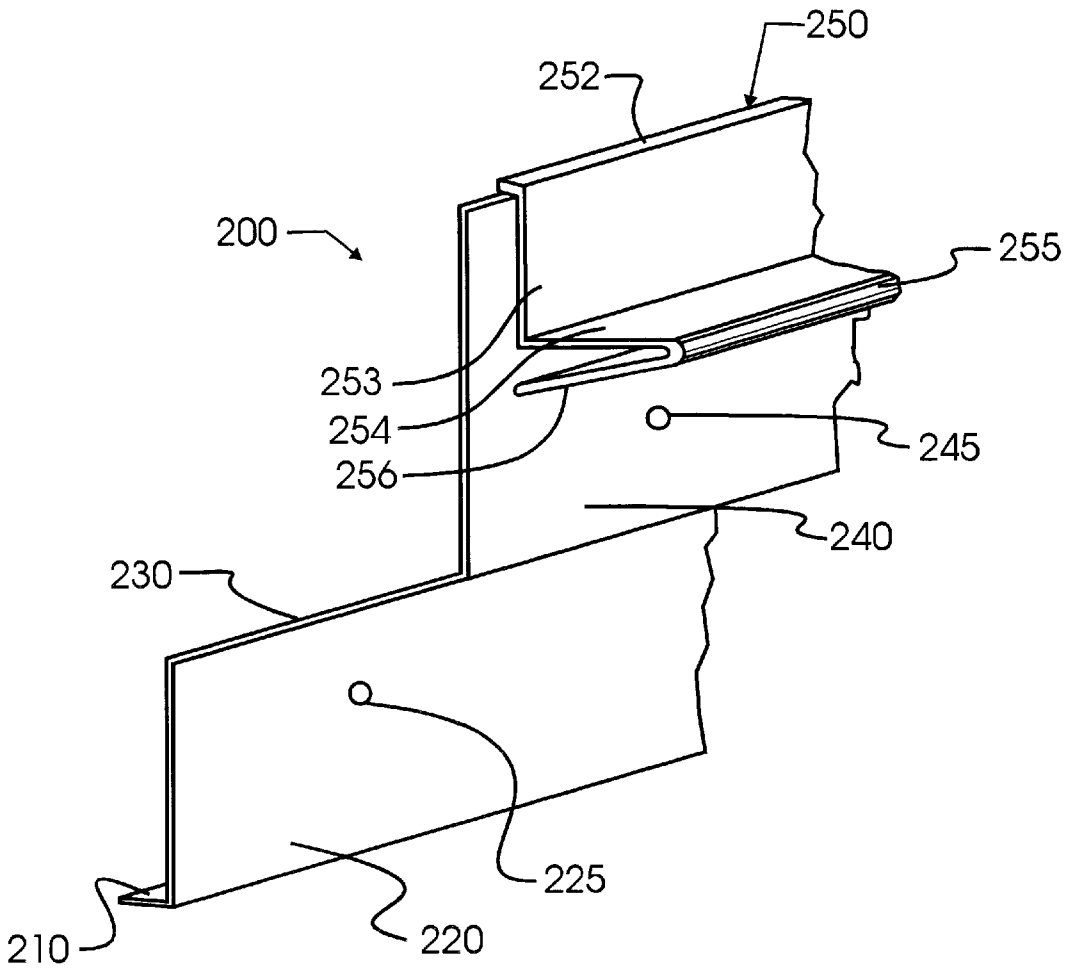
FIG. 3 illustrates an inside projected view of the linear footing form of FIG. 2.

Holes 225, 245, 145 and 305 are provided to allow tie rods to be placed therethrough, as will be described in greater detail with reference to FIG. 5. As can be seen from FIGS. 2 and 3, linear forms 100 and 200 may be fabricated relatively simply from sheet metal stock by drilling or punching holes 125, 126, 145–147, 225, 226, and 245–247, followed by bending within a metal brake. Support ledges 150, 250 are most preferably preformed by similar bending in a metal brake, and, subsequent to all metal brake bending of components, support ledges 150, 250 may be permanently or removably attached to top extensions 140, 240 by suitable technique. Most preferably, spot welding forms a permanent attachment therebetween, owing to the relatively low cost, simplicity and reliability of spot welding, though any suitable technique may be used. As can be best seen in FIG. 2, a relatively large number of linear footing forms 100 may be stacked during storage and transport in a relatively small space. Only support ledges 150, 250 extend out from form 100, so a relatively tight stacking arrangement is possible with the preferred embodiment. For applications where it might be desirable, support ledges 150, 250 could further be removed from forms 100, 200, to yield a fully and tightly stackable structure.

Figure 4:
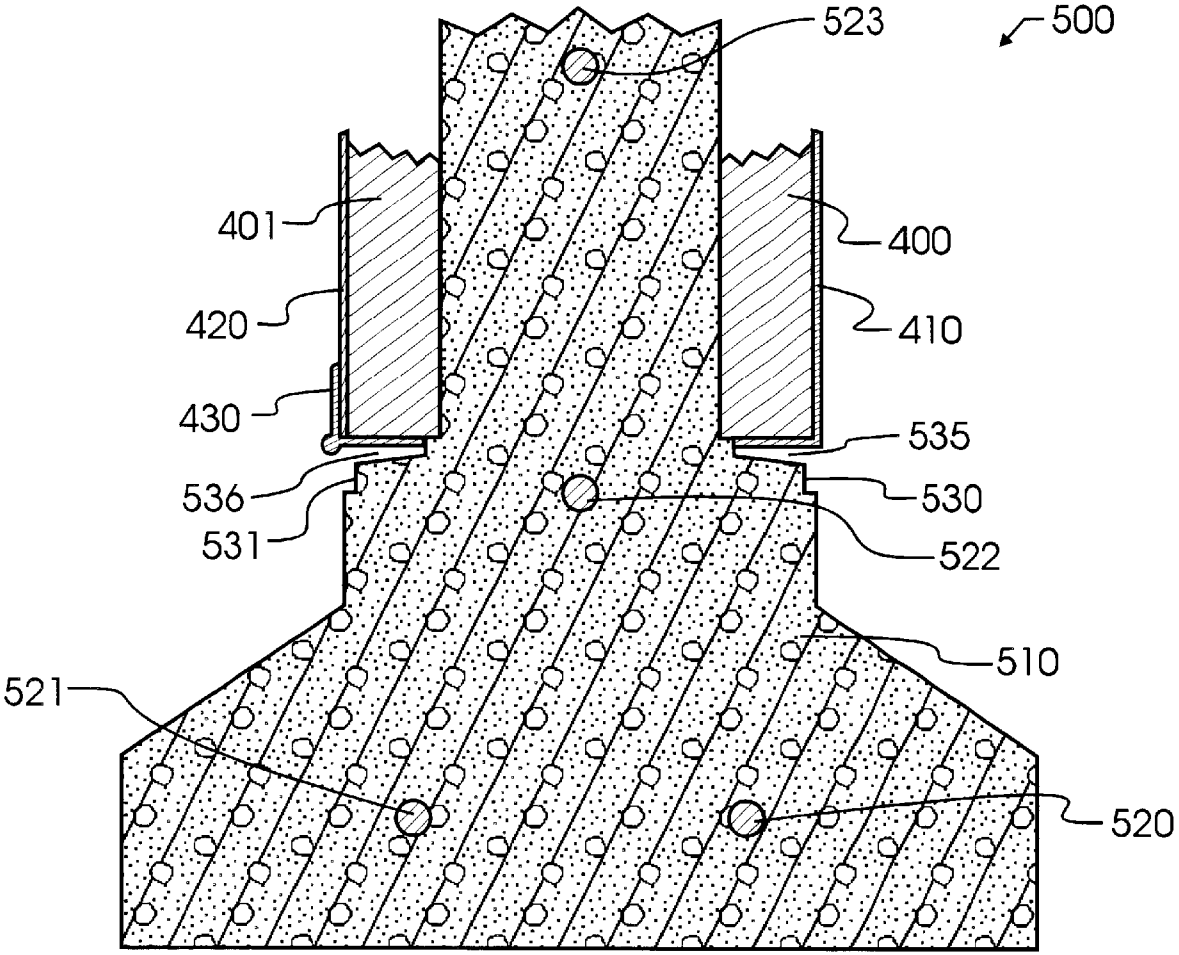
FIG. 4 illustrates the monolithic wall and footing that results from the use of the preferred embodiment footing forms of the present invention.

FIG. 4 illustrates the finished wall 500, formed by a monolithic casting using the preferred embodiment footing forms 100, 200 of the present invention in combination with prior art foamed resin wall forms 400, 401. Wall 500 includes a concrete monolithic core 510 which has iron re-bars 520, 521, 522 and 523 extending therein. While re-bars 520–523 are illustrated as extending longitudinally within monolithic core 510, which provides a great deal of strength and which does not provide a metal thermal path from inside to outside, it should be noted that additional or alternative rebars may extend vertically and transversely within monolith 510, as may be deemed appropriate at the time of pouring concrete. Small notches 530, 531 and 535, 536 are formed which are complimentary in geometry to foam support ledges 150 and 250. Into notch 535 on the interior building surface of wall 500 is most preferably a section of metal flashing 410 which could, for example, be fashioned from aluminum fascia. Flashing 410 is placed to protect foamed resin form 400 from insects, since a concrete floor will typically be poured at an elevation slightly above notch 535. Without flashing 410, notch 535 and the bottom of form 400 would then be accessible to insects from the earth underneath the concrete floor. Once flashing 410 is placed, caulk will typically be inserted into notch 535.

Along the exterior of wall 500, foamed resin form 401 is covered, for example, with self-furring mesh 420 and stucco bead 430, which in turn may be coated with stucco or other suitable material to form an insect-resistant exterior base. Once stucco bead 430 has been placed, notch 536 will most preferably be filled with caulking.

Figure 5:
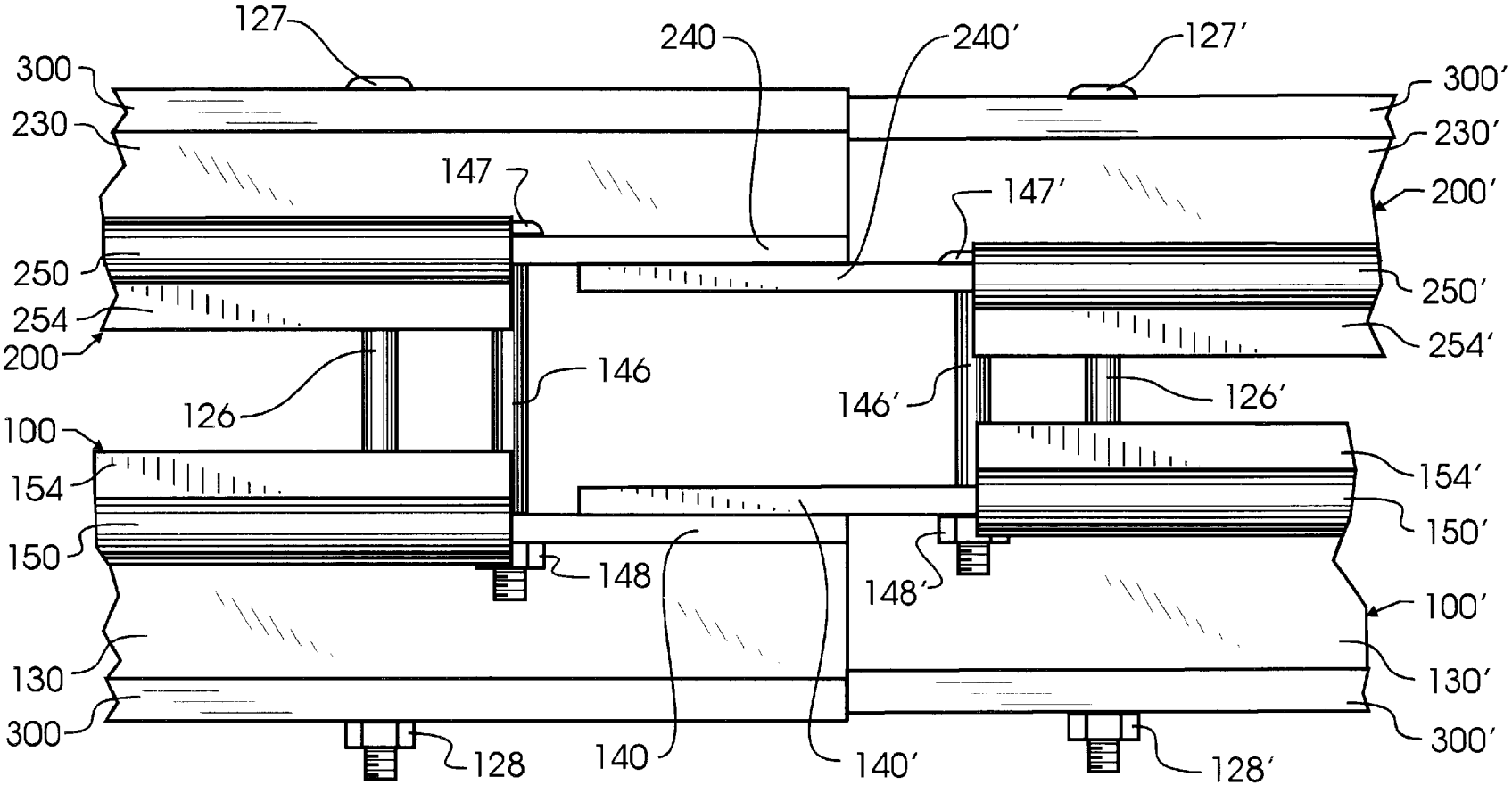
FIG. 5 illustrates the linear interconnection between two sections of preferred embodiment footing forms.

FIG. 5 illustrates the interconnection of linear footing forms 100, 200 with additional linear footing forms 100', 200' to form an elongated, continuous footing form. While linear extensions are illustrated, corner pieces such as those described hereinbelow with reference to FIGS. 6–8 could be substituted for either forms 100, 200 or forms 100', 200' without departing from the spirit of the invention. Bolts 127' and 147' will most preferably be tightened through rotary motion with nuts 128'and 148'against spacer sleeves 126'and 146', respectively. By loosening bolts 127, 147 slightly through rotary motion with nuts 128 and 148, footing form 100 will slip over the outside of footing form 100' while footing form 200 simultaneously slides over footing form 200'. When bolts 127, 147 are tightened down, form 100 will be tightly pressed against form 100' and form 200 will be tightly forced against form 200'. Most preferably, support ledges 150, 250 longitudinally terminate several inches prior to the longitudinal termination of vertical walls 120, 220 and 140, 240. This leaves a small region where there will be no obstacles or interference when sliding form 100 over form 100', which thereby permits limited longitudinal adjustment of forms. Through this longitudinal adjustment, footing forms 100, 200 and 100', 200' can be adjusted to completely fill an intended wall span without necessitating cutting forms 100, 200, and without requiring an undue inventory of lengths of footing forms. Sleeves or jackets 126, 146, 126', 146', maybe used as a stop against which vertical walls 120, 220 and 140, 240 may be tightened to accurately and repeatedly space these walls. In addition, these sleeves surround bolts 127, 147, 127', 147' to isolate these bolts from contact with concrete. The sleeves or jackets, once the concrete has cured, will remain in the concrete. However, bolts 127, 147, 127', 147' will be removed, and, subsequently, forms 100, 200, 100', 200' will be removed for future re-use. A particular feature of support ledges 150, 250 which assists in the removal of footing forms is best visible in FIG. 3 with reference to support ledge 250. As can be seen therein, ledge 250 includes a small wrap 252 formed between back overhang 251 and front overhang 253. This wrap provides some spring tension during the initial engagement between support ledge 250 and top extension 240. Extending perpendicular to front overhang 253 is horizontal ledge 254 upon which foamed resin wall form 401 rests. A second sharp angle wrap 255 returns from support ledge 250 to spacer 256. The combination of horizontal ledge 254, wrap 255 and spacer 256 forms a small v-shaped gap. This gap is very consequential subsequent to monolithic pouring. When concrete begins to cure, there is a finite amount of shrinkage, and also a finite and substantial amount of weight bearing down against horizontal ledge 254. Where wrap 255 and spacer 256 are not provided, horizontal ledge 254 tends to compress between foamed resin wall form 401 and the concrete. Since concrete is quite abrasive and has a relatively high co-efficient of friction against steel or aluminum, it is possible to load ledge 254 so greatly that, without spacer 256 causing groove 536 to be v-shaped, support ledge 250 may not be removable from concrete monolith 510. Most preferably, spacer 256 will extend almost entirely back to top extension 240. That way, cementitious material is less likely to get trapped between ledge 254 and spacer 256. Furthermore, the combined structure of ledge 254, wrap 255 and spacer 256 will most preferably be resilient, though ordinary steel may in most cases offer sufficient resilience.

Figure 6:
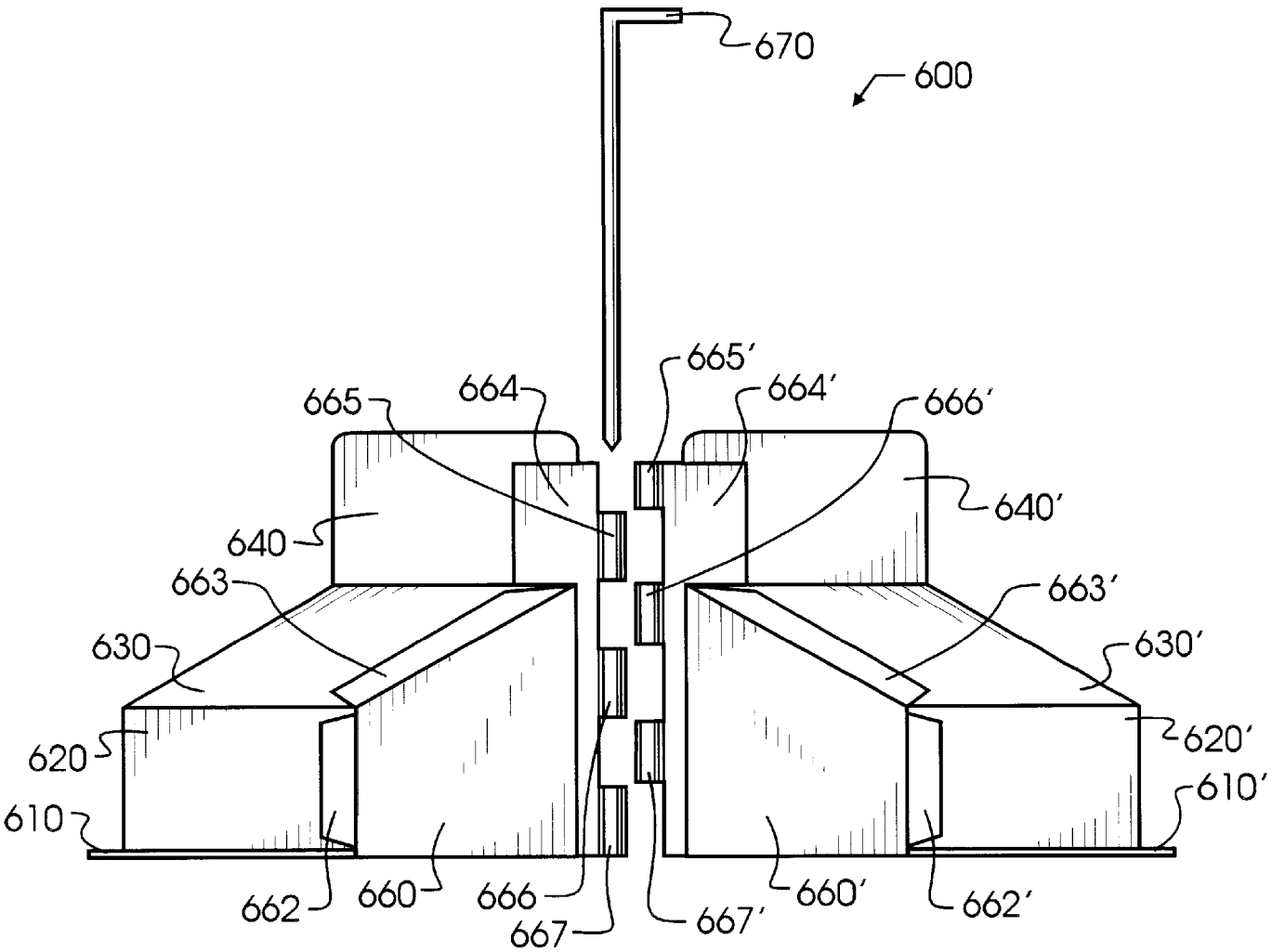
FIG. 6 illustrates a preferred embodiment outside corner from a side plan view.
Figure 7:
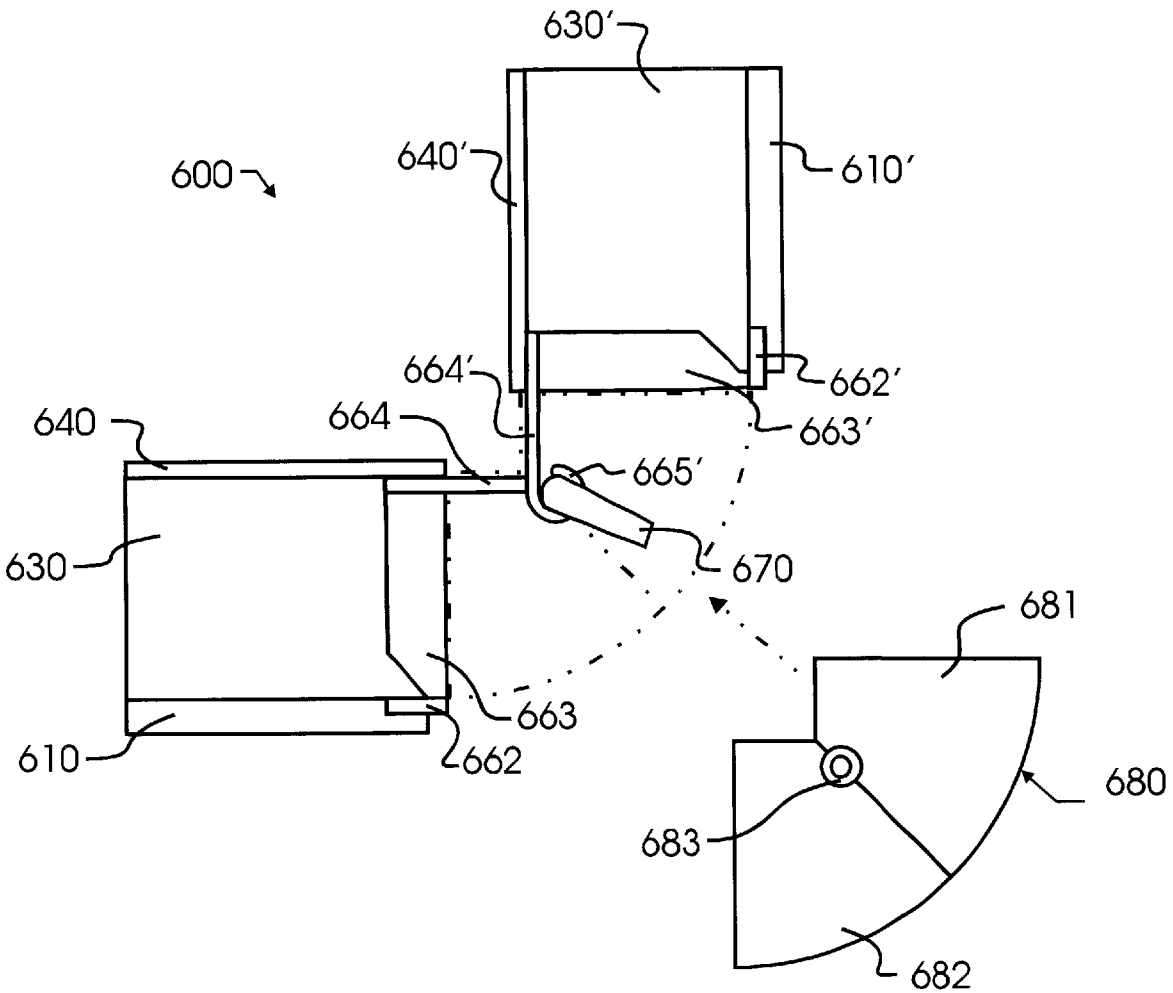
FIG. 7 illustrates a top plan view of the outside corner of FIG. 6, and further includes a preferred corner cap for protecting the preferred embodiment outside corner from accidental spills.

Outside corner 600, shown in FIGS. 6 and 7, allows infinitely variable angular adjustment. Surfaces 610–640 and 610'–640' are shaped as are surfaces 110–140, and will be interconnected thereto as described hereinabove with regard to FIG. 5. However, these surfaces are enclosed at a first longitudinal end to prevent the release of uncured concrete or liquid. Cap 660 acts as the closure for the left hand half of corner piece 600, while cap 660' closes the right half. Caps 660 and 660' are most preferably formed integrally with hinge frames 664, 664', and tabs 662, 662', 663, 663' from a single piece of stamped and bent sheet metal. Tabs 662, 662', 663, 663' provide overlap which may be used for permanent attachment to adjacent surfaces 620, 620', 630, 630' respectively, such as by spot welding or other suitable attachment. Hinge frames 664 and 664' include complimentary hinge pin guides 665–667 and 665'–667'. Hinge pin 670 is passed through the hinge pin guides most preferably at the job site at the time of lay-out of footing forms, and is designed to be substantially longer than corner 600 is otherwise high, so that when fully inserted into hinge pin guide 665', hinge pin 670 will extend from guide 667 down into the earth. By so designing the relative sizes, hinge pin 670 will not only create an adjustable angle within corner 600, but will also serve as an anchor of corner 600 that may be used to keep corner 600 fixedly positioned and vertical. An adjustable cover 680 will, most preferably also be provided as shown in FIG. 7. Cover section 681 is designed to rotate about ring 683 relative to cover section 682 to progressively cover or uncover section 682. While two sections 681, 682 are illustrated, those of ordinary skill will at once recognize that one or many leaves may also be used. The more leaves provided, the greater the angular adjustment available with which to cover corner 600. However, the thickness parallel to the axis of hinge pin 670 also increases with more sections, as does the cost and complexity of cover 680. Cover 680 is most preferably inserted between hinge pin guides 665 and 666' at the time of assembly of corner 600, by passing hinge pin 670 through ring 683.

Figure 8:
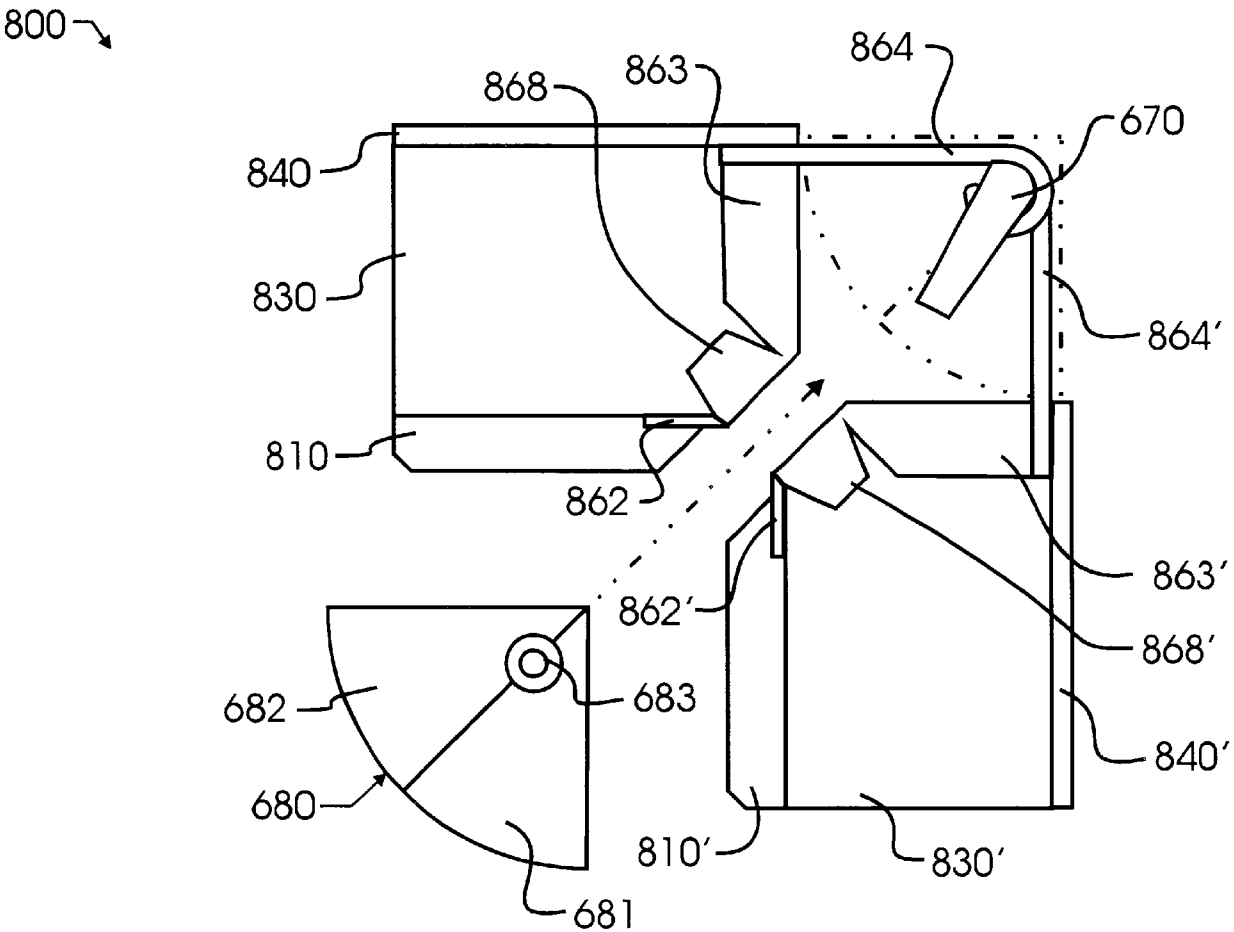
FIG. 8 illustrates a top plan view of a preferred embodiment inside corner from a top plan view, and further includes a preferred corner cap for protecting the preferred embodiment inside corner from accidental spills.

FIG. 8 illustrates a preferred inside corner 800 which is quite similar to outside corner 600, with the notable addition of a taper that includes additional tabs 868 and 868'. This taper helps to allow corner 800 to be disassembled, even when errant concrete makes it into the region normally covered by adjustable cover 680. The errant concrete may be removed through the open area between tabs 868 and 868'.

The preferred embodiment of the present invention is most preferably fabricated from sheet metal stock, excepting lumber 2×4s 300 and hinge pins 670. Where sheet metal stock is used, the stock may be bent quite simply in a metal brake. The preferred embodiment molds may then be manufactured for relatively low cost, and will endure many uses. Special surface treatments may be applied to the metal as may be appropriate for a given application. For example, where steel is used as the material of the form, the steel may be galvanized in advance to prevent undesired corrosion. Furthermore, at the job site, the steel will most preferably be sprayed or coated with commercial mold release designed for use with concrete. Alternatively, other materials such as various plastics may be used in the fabrication of the components of the preferred embodiment, in which case such plastic might be molded, stamped from sheet, or extruded through an appropriate extrusion die. Other materials too numerous to mention may also find application within the present invention.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

I claim:

1. A static mold for casting a building footing and building wall monolithically from cementitious material using a removable footing form and a foamed resin wall form permanently retained as a part of said building wall and footing monolith in combination, said foamed resin wall form comprising:

first and second major interior surfaces spaced apart from and facing each other between which said cementitious material is poured;

first and second major exterior surfaces;

a base having first and second minor surfaces;

said footing form comprising:

first and second footing mold walls, each having a first end, a base extending from said first end longitudinally to a second end along a first longitudinally extending edge, and a top spaced transversely from said base along a second longitudinally extending edge;

a spacer separating said first and second footing mold walls from each other and thereby forming an open space therebetween for said cementitious material;

a first support having a surface extending from said first footing mold wall towards said second footing mold wall and extending longitudinally along said first footing mold wall for vertically supporting said first minor surface of said foamed resin wall form, and having a first support spacer that maintains a gap between said first minor surface of said foamed resin wall form and said cementitious material that is larger adjacent said footing mold walls and smaller distal to said footing mold walls to facilitate separation of said footing form from said foamed resin wall form and said cementitious material; and a second support having a surface extending from said second footing mold wall towards said first footing mold wall and extending longitudinally along said second footing mold wall for vertically supporting said second minor surface of said foamed resin wall form, and having a second support spacer that maintains a gap between said first minor surface of said foamed resin wall form and said cementitious material that is larger adjacent said footing mold walls and smaller distal to said footing mold walls to facilitate separation of said footing form from said foamed resin wall form and said cementitious material;

said foamed resin wall form further supported horizontally and transverse to said longitudinally extending edge by interaction between said first footing mold wall, said second footing mold wall and said first and second major exterior surfaces;

said support separable from said cementitious material and said foamed resin wall form subsequent to a curing of said cementitious material without disrupting either said cementitious material or said foamed resin wall form.

2. The static mold for casting a building footing and building wall monolithically from cementitious material of claim 1, wherein said first and second support spacers are resilient.

3. The static mold for casting a building footing and building wall monolithically from cementitious material of claim 1, wherein said support for said foamed resin wall form further comprises a u-shaped section for hanging said support from said first footing mold wall top.

4. The static mold for casting a building footing and building wall monolithically from cementitious material of claim 1, wherein said support for said foamed resin wall form extends longitudinally less than said bases and tops of said first and second footing mold wall.

5. The static mold for casting a building footing and building wall monolithically from cementitious material of claim 1, wherein said first and second footing mold walls are fabricated from steel.

6. The static mold for casting a building footing and building wall monolithically from cementitious material of claim 1, wherein said spacer is adjustable to accommodate various spacings between said first and second major exterior surfaces.

7. The static mold for casting a building footing and building wall monolithically from cementitious material of claim 6, wherein said spacer is adjusted to further mechanically retain an adjacent static footing form.

8. A removable form for shaping a subterranean footing portion of a monolithic concrete footing and wall, wherein said wall is further characterized by a foam form for shaping said wall which remains permanently with said monolithic concrete, comprising:

first and second longitudinally extensive walls for retaining concrete in a longitudinally extensive shape;

a spacer for adjusting a first spacing between said first and second walls; and first and second supporting ledges each having a vertical support face and a horizontal support face, said vertical support face of said first supporting ledge extending from said first wall for vertically supporting said foam form, said vertical support face of said second supporting ledge extending from said second wall for vertically supporting said foam form, and said horizontal support faces each horizontally supporting said foam form and facing each other to form a horizontal space within which said foam form is located and retained horizontally, and further having first and second concrete forming surfaces extending beneath each of said first and second supporting ledge vertical support faces against which said monolithic concrete is formed;

whereby said removable form is removable from said monolithic concrete and said foam form subsequent to a curing of said concrete without disrupting either said concrete or said foam form.

9. The form for shaping a subterranean footing portion of a monolithic concrete footing and wall of claim 8, wherein said first concrete forming surface is a first distance from said first supporting ledge vertical support face adjacent said first wall and is a second distance from said first supporting ledge vertical support face distal to said first wall, said first distance greater than said second distance.

10. The form for shaping a subterranean footing portion of a monolithic concrete footing and wall of claim 9, wherein said first concrete forming surface and said first supporting ledge are resiliently biased apart said first distance, whereby, upon application of a force of sufficient magnitude to overcome said resilient bias and directed to compress said first distance, said first distance will be reduced.

* * * * *